US009372434B2

(12) United States Patent
Hayashi et al.

(10) Patent No.: US 9,372,434 B2
(45) Date of Patent: Jun. 21, 2016

(54) IMAGE FORMING APPARATUS WITH LUBRICATED DEVELOPER CARRYING MEMBER

(71) Applicant: CANON KABUSHIKI KAISHA, Tokyo (JP)

(72) Inventors: Kodai Hayashi, Suntou-gun (JP); Yoshihiro Mitsui, Numazu (JP); Hisashi Taniguchi, Suntou-gun (JP); Shuhei Kawasaki, Susono (JP); Shunsuke Matsushita, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/636,357

(22) Filed: Mar. 3, 2015

(65) Prior Publication Data

US 2015/0261129 A1 Sep. 17, 2015

(30) Foreign Application Priority Data

Mar. 11, 2014 (JP) ..... 2014-047689
Jan. 26, 2015 (JP) ..... 2015-011979

(51) Int. Cl.
*G03G 15/08* (2006.01)
*G03G 15/06* (2006.01)

(52) U.S. Cl.
CPC ..... *G03G 15/065* (2013.01); *G03G 15/0806* (2013.01)

(58) Field of Classification Search
CPC ..... G03G 15/0812
See application file for complete search history.

(56) References Cited

U.S. PATENT DOCUMENTS 5,363,182 A * 11/1994 Kuribayashi ..... G03G 21/0017 15/256.5
7,398,040 B2 * 7/2008 Yoshida ..... G03G 15/0812 399/149
8,304,066 B2 * 11/2012 Anderson ..... G03G 15/0812 428/323
2011/0150512 A1 * 6/2011 Tamagaki ..... G03G 21/0094 399/53

FOREIGN PATENT DOCUMENTS

JP 2002-229333 A 8/2002

OTHER PUBLICATIONS

Yoshihiro Mitsui et al., U.S. Appl. No. 14/640,606, filed Mar. 6, 2015.

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image forming apparatus configured to form an image with developer includes an image bearing member configured to bear an image of the developer, a developer carrying member configured to carry the developer to supply the developer to the image bearing member, and a developer supplying member configured to supply the developer to the developer carrying member. At least a part of a surface of the developer carrying member is coated with lubricant charged to the same polarity as the developer, and an absolute value of a charge amount per unit mass of the lubricant is larger than that of the developer. The image forming apparatus executes a first sequence of applying a potential difference between the developer supplying member and the developer carrying member before image formation to form an electric field to suppress movement of the charged lubricant from the developer carrying member to the developer supply member.

16 Claims, 14 Drawing Sheets

FIG. 8

| | TONER SUPPLY ROLLER BIAS [V] | LIGHT INTENSITY OF LASER BEAM [$\mu$J/cm$^2$] | WITH/WITHOUT INTERVAL A |
|---|---|---|---|
| SECOND EMBODIMENT | −650 | 0.37 | WITH |
| COMPARATIVE EXAMPLE 1 | −500 | 0.2 | WITHOUT |
| COMPARATIVE EXAMPLE 2 | −650 | 0.37 | WITHOUT |
| COMPARATIVE EXAMPLE 3 | −500 | 0.2 | WITH |

FIG. 9

| | | NUMBER OF PRINTED SHEETS OF ENDURANCE [SHEETS] | | | | |
|---|---|---|---|---|---|---|
| | | JUST AFTER | 5000 | 10000 | 15000 | 20000 |
| SECOND EMBODIMENT | UNEVEN DENSITY | A | A | A | A | A |
| | WHITE DOT | A | A | A | B | B |
| COMPARATIVE EXAMPLE 1 | UNEVEN DENSITY | C | C | B | B | B |
| | WHITE DOT | A | A | B | C | C |
| COMPARATIVE EXAMPLE 2 | UNEVEN DENSITY | B | B | A | A | A |
| | WHITE DOT | A | A | A | B | B |
| COMPARATIVE EXAMPLE 3 | UNEVEN DENSITY | B | B | A | A | A |
| | WHITE DOT | A | A | B | B | C |

FIG. 11

| | | NUMBER OF PRINTED SHEETS OF ENDURANCE [SHEETS] | | | | |
|---|---|---|---|---|---|---|
| | | JUST AFTER | 5000 | 10000 | 15000 | 20000 |
| THIRD EMBODIMENT | UNEVEN DENSITY | A | A | A | A | A |
| | WHITE DOT | A | A | A | A | A |
| SECOND EMBODIMENT | UNEVEN DENSITY | A | A | A | A | A |
| | WHITE DOT | A | A | A | B | B |

FIG. 12

| | POTENTIAL DIFFERENCE BETWEEN DEVELOPING ROLLER AND TONER SUPPLY ROLLER | LUBRICANT AMOUNT ON SURFACE OF DEVELOPING ROLLER [MILLIGRAM] | | | |
|---|---|---|---|---|---|
| | | AFTER 0 SECONDS | AFTER 1 SECOND | AFTER 2 SECONDS | AFTER 3 SECONDS |
| FIRST EMBODIMENT | Δ −250 V | 50 | 45 | 40 | 35 |
| COMPARATIVE EXAMPLE | Δ 0 V | 50 | 25 | 0 | 0 |

IMAGE FORMING APPARATUS WITH LUBRICATED DEVELOPER CARRYING MEMBER

BACKGROUND OF THE INVENTION

1. Field of the Invention

The present invention relates to an image forming apparatus configured to form an image with use of developer.

2. Description of the Related Art

Hitherto, a developing device has been installed on an electrophotographic or electrostatic-recording image forming apparatus such as an electrophotographic copying machine, a laser beam printer, and a fax machine. The developing device mainly includes a developing roller (developer carrying member) and a developer amount regulating blade. The developing roller is configured to close an opening of a developer container configured to accommodate developer therein, and is arranged in a partially exposed manner. The developer amount regulating blade is configured to abut against the surface of the developing roller, to thereby keep the amount of the developer conveyed by the developing roller constant.

When the developer adhering on the surface of the developing roller passes through between the surface of the developing roller and the developer amount regulating blade along with the rotation of the developing roller, a surplus amount of the developer is removed from the surface of the developing roller so as to be returned into the developer container. Thus, the developer is formed as a thin layer on the developing roller. Simultaneously, triboelectrification charges are applied to the developer due to the friction with the developer amount regulating blade. Thus, the developer moves from the part of the developing roller, which is exposed from the developer container, onto an electrostatic latent image formed on a surface of a rotating photosensitive drum opposed to the developing roller. Further, the developing device may include a developer supplying member configured to supply the developer to the developer carrying member or a developer collecting member configured to collect the developer on the developer carrying member.

Incidentally, it has become a general system to deliver the developing device as described above from a manufacturer to a user in a form of a removably mountable cartridge. For example, when the developing device does not contain enough developer and thus an image is unprintable, a new developing device in a form that is removably mountable to the image forming apparatus is purchased. The developing device is used by being inserted into the main body of the image forming apparatus. Further, from the viewpoint of preventing developer from leaking out from the developing container during conveyance, the new developing device is often maintained in a state in which the developer is sealed in a developer containing portion inside the developing device until the developing device is delivered to the user from the manufacturer.

That is, the new developing device is in a state in which the surface of the developing roller is not coated with the developer. Therefore, when the new developing device is inserted into the apparatus main body and the developing roller is rotated, an extremely large torque is generated between the developing roller and an abutment member such as the developer amount regulating blade and the developer supplying member. As a result, a significant problem may occur, such as damage on the abutment member or on a driving system for the developing device.

Therefore, as disclosed in, for example, Japanese Patent Application Laid-Open No. 2002-229333, there has been proposed a method of coating, in advance, the surface of the developing roller before use with a powder coating agent as lubricant.

When such a coating agent is used, however, the following problem may occur.

That is, during an initial operation at the start of the use of the cartridge, if the coating agent applied on the developer carrying member is immediately transferred from the developer carrying member onto the developer supplying member, no lubricant remains on the surface of the developer carrying member. In this case, the frictional force between the developer carrying member and the developer amount regulating blade and the frictional force between the developer carrying member and the developer supplying member increase so that the load necessary for rotating the developer carrying member is increased. In other words, a large load may be applied to the driving system for the developing device.

In order to address this problem, it is necessary to retain the coating agent on the surface of the developer carrying member until the toner is supplied to the developer carrying member so that the surface of the developer carrying member is sufficiently coated with the toner.

Further, as another problem, the coating agent may adversely affect an image during image formation. In other words, when the coating agent remains on the developing roller or inside the developing container even after the start of the use of the cartridge, the coating agent and the developer are present on the surface of the developing roller in a mixed manner. The coating agent is charged (carries charges) when being rubbed against the developer amount regulating blade or the developer supplying member. When an image is formed in this state, the coating agent may adversely affect the image so that there may be a problem in that a defective image such as an image with uneven density or an image with white dots (part in the image without toner (or with very little toner) occurring in a dotted pattern) occurs.

Such a defective image remarkably appears in a case of using, for example, a coating agent that is charged to the same polarity as the developer, and has a high charging ability (is easily charged) as compared to that of the developer. This is because the coating agent having a high charge affects the developer to carry an excessive charge (in other words, the developer is more charged than usual).

In order to prevent the image defects to be caused by the coating agent, it is necessary to execute a sequence of discharging the coating agent outside of the developing container after the start of the use of the developing device.

In order to execute this sequence, it may be effective to cause the developer carrying member to once retain the lubricant (collect the lubricant onto the developer carrying member), and then transfer the lubricant from the developer carrying member onto an image bearing member.

SUMMARY OF THE INVENTION

In view of the above-mentioned problems, the present invention provides an image forming apparatus configured to execute a sequence of retaining lubricant on a developer carrying member.

As a representative configuration according to one embodiment disclosed in the present application, there is provided an image forming apparatus, which is configured to form an image with use of developer, the image forming apparatus comprising: an image bearing member configured to bear an image of the developer; a developer carrying member configured to carry the developer so as to supply the developer to the image bearing member; and a developer supplying member configured to supply the developer to the developer carrying member, wherein at least a part of a surface of the developer carrying member is coated with lubricant, wherein the lubricant is to be charged to the same polarity as the developer, wherein an absolute value of a charge amount per unit mass of the lubricant is larger than an absolute value of a charge amount per unit mass of the developer, and wherein the image forming apparatus is configured to execute a first sequence of applying a potential difference between the developer supplying member and the developer carrying member before image formation to form an electric field in a direction in which the lubricant is directed from the developer supplying member toward the developer carrying member.

Further features of the present invention will become apparent from the following description of exemplary embodiments with reference to the attached drawings.

BRIEF DESCRIPTION OF THE DRAWINGS

FIG. 8 is a table showing a toner supply roller bias, light intensity of a laser beam, and presence or absence of an interval A in a second embodiment and comparative examples.

FIG. 9 is a table showing results of a verification experiment performed in the second embodiment and the comparative examples shown in FIG. 8.

FIG. 11 is a table showing results of verification of an effect when the third embodiment and the second embodiment are compared with each other.

FIG. 12 is a table showing results of a verification experiment in the first embodiment and a comparative example.

DESCRIPTION OF THE EMBODIMENTS

Now, with reference to the drawings, embodiments of the present invention are described in detail. Unless particular description is made, the dimensions, materials, shapes, relative arrangements, and the like of the components described below in the embodiments are not intended to limit the scope of the present invention to only those described in the embodiments.

First Embodiment

Overall Configuration of Image Forming Apparatus

An overall configuration of an electrophotographic image forming apparatus according to an embodiment will be described.

Figure 1:
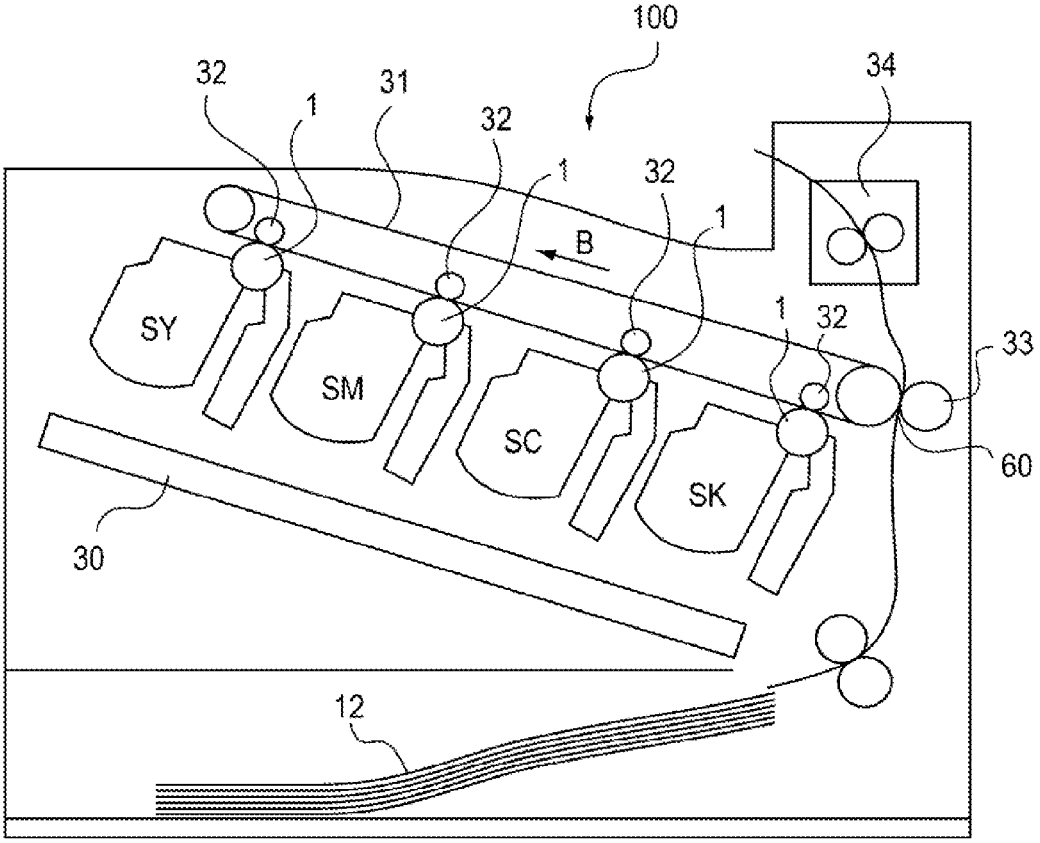
FIG. 1 is a schematic view illustrating a schematic configuration of an image forming apparatus according to an embodiment.

FIG. 1 is a schematic view illustrating a schematic configuration of an image forming apparatus 100 according to the embodiment.

The image forming apparatus 100 is a full-color laser beam printer employing an in-line and intermediate transfer system. The image forming apparatus 100 is configured to form, according to image information, a color image on a recording material such as a sheet, a plastic sheet, or fabric. The image information is input from an image reading apparatus (not shown) connected to the image forming apparatus 100 or a host apparatus (not shown) such as a personal computer connected to the image forming apparatus 100 for communication, to the image forming apparatus 100.

The image forming apparatus 100 includes process cartridges SY, SM, SC, and SK removably mounted to a main body of the image forming apparatus 100.

Note that, the main body refers to a part excluding the respective process cartridges S (SY, SM, SC, and SK) from the configuration of the image forming apparatus 100. The process cartridges SY, SM, SC, and SK respectively serve as image forming units configured to form images of respective colors of yellow (Y), magenta (M), cyan (C), and black (K).

Each of the process cartridges SY, SM, SC, and SK is removably mountable to the main body of the image forming apparatus 100 through intermediation of a mounting unit (not shown) such as a mounting guide and a positioning member, the mounting unit being provided in the main body of the image forming apparatus 100. In the embodiment, the process cartridges SY, SM, SC, and SK for the respective colors all have the same shape, and respectively contain toner of respective colors of yellow (Y), magenta (M), cyan (C), and black (K).

Photosensitive drums 1 (image bearing members) are rotationally driven by a driving unit (not shown). Below the photosensitive drums 1, a scanner unit 30 (laser beam irradiation unit: laser beam irradiation device) is arranged. The scanner unit 30 irradiates, according to the image information, the photosensitive drum 1 with laser, to form an electrostatic latent image. An endless intermediate transfer belt 31 is arranged so as to be opposed to the four photosensitive drums 1. The intermediate transfer belt 31 is configured to transfer the toner images on the photosensitive drums 1 onto a recording material 12.

The intermediate transfer belt 31 is brought into abutment against the four photosensitive drums 1, and is rotated and circulated in the direction indicated by the arrow B. On the side of the inner circumferential surface of the intermediate transfer belt 31, four primary transfer rollers 32 are arranged so as to be opposed to the four photosensitive drums 1, respectively. Then, a primary transfer bias source (not shown) applies, to each of the primary transfer rollers 32, a bias with an opposite polarity to a normal charging polarity of the toner. With this, the toner image on the photosensitive drum 1 is primarily transferred onto the intermediate transfer belt 31.

Further, on the side of the outer circumferential surface of the intermediate transfer belt 31, a secondary transfer roller 33 is arranged. A secondary transfer bias source (not shown) applies, to the secondary transfer roller 33, a bias with an opposite polarity to the normal charging polarity of the toner. With this, the toner image on the intermediate transfer belt 31 is secondarily transferred onto the recording material 12.

When a full-color image is formed, the above-mentioned process is sequentially performed in the process cartridges SY, SM, SC, and SK, and the toner images of the respectively colors are sequentially primarily transferred onto the intermediate transfer belt 31 in an overlapping manner. After that, in synchronization with the movement of the intermediate transfer belt 31, the recording material 12 is conveyed to a secondary transfer portion 60. With the action of the secondary transfer roller 33 abutting against the intermediate transfer belt 31 through the recording material 12 at the secondary transfer portion 60, the four-color toner images on the intermediate transfer belt 31 are secondarily transferred onto the recording material 12 in a collective manner.

The recording material 12 having the toner images transferred thereon is conveyed to a fixing device 34. The fixing device 34 applies heat and pressure to the recording material 12 to fix the toner images onto the recording material 12.

(Configuration of Process Cartridge)

An overall configuration of the process cartridge to be mounted to the image forming apparatus of the embodiment will be described. Note that, in the embodiment, the configurations and operations of the process cartridges SY, SM, SC, and SK for the respective colors are substantially the same except for the type (color) of the contained developer. Therefore, in the following description, the process cartridge SC is exemplified as a representative.

Figure 2:
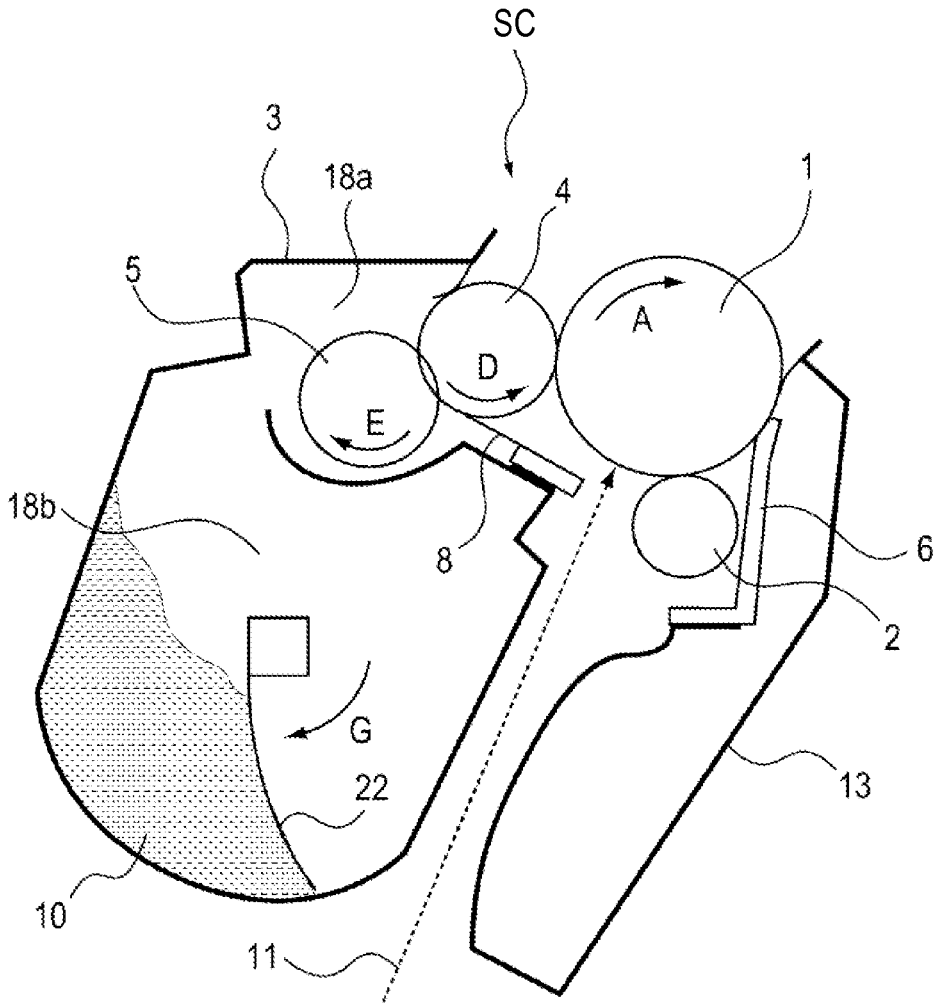
FIG. 2 is a sectional view of a process cartridge of the image forming apparatus according to the embodiment.

FIG. 2 is a sectional view (cross section perpendicular to the rotation axis) of the process cartridge SC taken along the line perpendicular to a rotation axis direction (longitudinal direction) of the photosensitive drum 1.

The process cartridge SC includes a photosensitive member unit 13 including the photosensitive drum 1, and a developing device 3 including a developing roller 4 (developer carrying member).

The photosensitive drum 1 is rotatably attached to the photosensitive member unit 13 through intermediation of a bearing (not shown). The photosensitive drum 1 receives a driving force from a driving motor (not shown) so as to be rotationally driven in the direction indicated by the arrow A based on the image forming operation.

Further, in the photosensitive member unit 13, a charging roller 2 and a cleaning member 6 are arranged so as to be brought into contact with a circumferential surface of the photosensitive drum 1. A charging bias source applies a charging bias to the charging roller 2. In the embodiment, a bias to be applied is set so that the potential of the surface of the photosensitive drum 1 (charging potential: Vd) is −500 V.

Then, the scanner unit 30 radiates a laser beam according to the image information to form an electrostatic latent image on the photosensitive drum 1. In the embodiment, the light intensity of the laser beam 11 is set to 0.2 $\mu J/cm^2$ during image formation, and the latent image potential is set to −150 V.

On the other hand, the developing device 3 includes a developing chamber 18*a* and a developer containing chamber 18*b*. The developer containing chamber 18*b* is arranged below the developing chamber 18*a*. The developer containing chamber 18*b* contains toner 10 (developer). In the embodiment, the normal charging polarity of the toner 10 is a negative polarity. In the following, a case where toner to be negatively charged is used will be described, but it is also possible to use toner to be positively charged.

Further, the developer containing chamber 18*b* includes a developer conveying member 22 configured to convey the toner 10 to the developing chamber 18*a*. The developer conveying member 22 rotates in the direction indicated by the arrow G to convey the toner to the developing chamber 18*a*. At this time, the developer conveying member 22 is driven so as to rotate at 67 rpm.

When the cartridge is shipped, a toner seal (not shown) is affixed on the opening of the developer containing chamber 18*b*. This is for suppressing movement of the toner 10 from the developer containing chamber 18*b* to the developing chamber 18*a* before the start of the use of the process cartridge SC. The toner seal is torn by the developer conveying member 22 at the start of the use of the process cartridge SC. At this time, the developer conveying member 22 is driven so as to rotate at 20 rpm, which is slower than that during the normal image formation.

Figure 14:
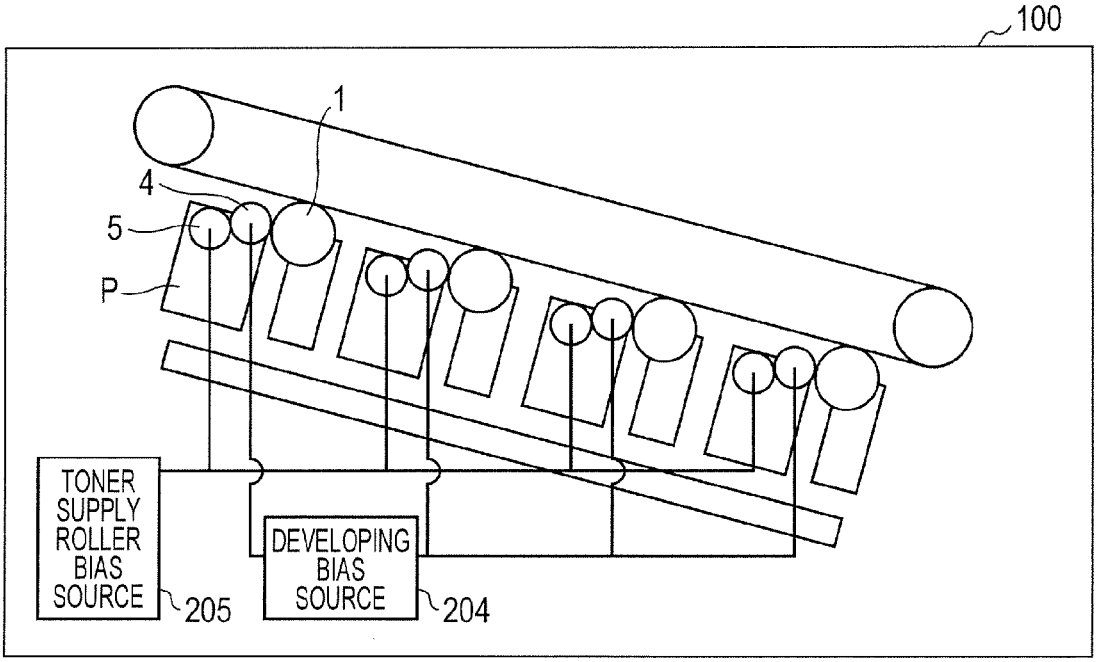
FIG. 14 is a block diagram illustrating voltage applying devices.

In the developing chamber 18*a*, the developing roller 4 is arranged so as to be brought into contact with the photosensitive drum 1. The developing roller 4 receives a driving force from a driving motor (not shown) so as to be rotated in the direction indicated by the arrow D. The developing roller 4 and the photosensitive drum 1 are rotated so that the surfaces thereof move in the same direction at the opposing portion (contact portion). Further, a developing bias source 204 (see FIG. 14, first voltage applying unit, first voltage applying device) applies, to the developing roller 4, a bias (voltage) sufficient for developing and visualizing the electrostatic latent image on the photosensitive drum 1 as a toner image. Note that, FIG. 14 is a block diagram illustrating a configuration of voltage applying devices (power sources).

Inside the developing chamber 18*a*, a toner supply roller 5 (developer supplying member) and a regulating member 8 are arranged. The toner supply roller 5 is configured to supply toner conveyed from the developer containing chamber 18*b* to the developing roller 4. The regulating member 8 is configured to regulate the coat amount of toner on the developing roller 4 and is also configured to charge the toner.

The toner supply roller 5 is an elastic sponge roller obtained by forming a foam layer on the outer circumference of a conductive cored bar, and is arranged so as to form a predetermined contact portion on the circumferential surface of the developing roller 4 at a portion opposed to the developing roller 4. Further, the toner supply roller 5 receives a driving force of the driving motor (not shown) so as to be rotated in the direction indicated by the arrow E. The developing roller is driven so as to rotate at 100 rpm, and the toner supply roller 5 is driven so as to rotate at 200 rpm.

Further, a toner supply roller bias source 205 (see FIG. 14, second voltage applying unit, second voltage applying device) applies a bias (voltage) to the toner supply roller 5. At this time, the bias is controlled so that the value obtained by subtracting the value of the bias to be applied to the developing roller 4 from the value of the bias to be applied to the toner supply roller becomes a value with the same polarity as the normal charging polarity of the toner 10 (negative polarity in the case of the embodiment). With this, a sufficient amount of toner is supplied from the toner supply roller 5 to the developing roller 4. In the embodiment, the bias to be applied to the toner supply roller 5 is controlled to be −500 V, and the bias to be applied to the developing roller 4 is controlled to be −400 V.

The toner supplied to the developing roller 4 by the toner supply roller 5 enters the contact abutment portion between the regulating member 8 and the developing roller 4 through the rotation of the developing roller 4 in the direction indicated by the arrow D. Then, the toner is triboelectrically-charged due to the rubbing between the surface of the developing roller 4 and the regulating member 8. Thus, the toner is charged, and simultaneously its layer thickness is regulated. The toner on the developing roller 4, which has its layer thickness regulated, is conveyed to a portion opposed to the photosensitive drum 1 by the rotation of the developing roller 4. Thus, the electrostatic latent image on the photosensitive drum 1 is developed and visualized as a toner image.

Note that, in the embodiment, the entire process cartridge SC including the photosensitive drum 1 and the developing device 3 is removably mountable to the main body of the image forming apparatus 100, but the developing device 3 alone may be removably mountable to the main body of the image forming apparatus 100.

(Composition of Lubricant)

Now, the lubricant applied on the developing roller 4 when the cartridge is shipped will be described. In the embodiment, as the lubricant, silicone resin particles (product name: Tospearl 120, produced by GE Toshiba Silicones Co., Ltd., average particle diameter: 2 μm) were used. Tospearl 120 has a property of being negatively charged, and exhibits a stronger negative polarity than that of toner. That is, the lubricant exhibits the same polarity as the charging polarity of the developer, and an absolute value of a charge amount per unit mass of the lubricant is larger than an absolute value of a charge amount per unit mass of the developer.

Note that, the type of the lubricant is not limited to the above-mentioned silicone resin particles.

(Measurement of Charge Amounts)

Now, a method of measuring the charge amounts of the developer and the lubricant in the embodiment will be described.

Figure 3:
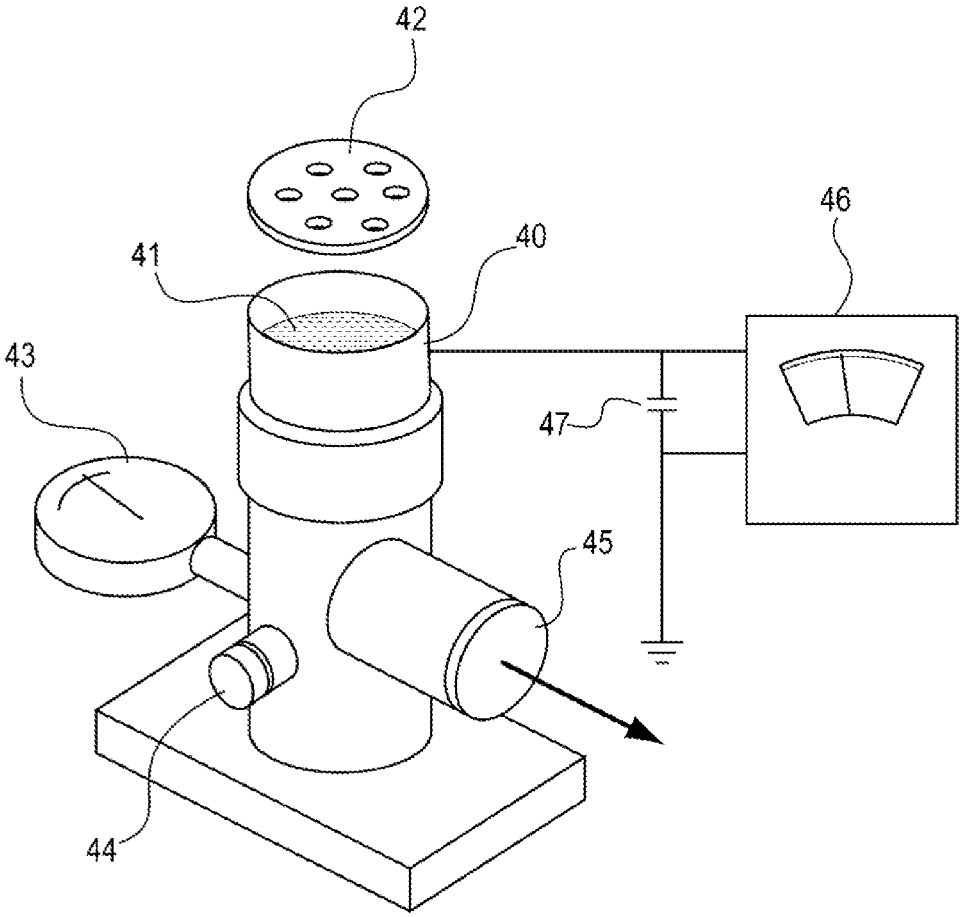
FIG. 3 is a view illustrating a configuration of a device configured to measure charge amounts of developer and lubricant, which is to be used in the embodiment.

FIG. 3 is a view illustrating a configuration of a device configured to measure the values of triboelectrification charges (charge amounts) for two components of developer and lubricant in order to measure the charge amounts of the developer and the lubricant.

F81-2535 (produced by Powdertech Co., Ltd.) is used as a carrier, and a mixture obtained by adding 0.4 (g) of developer and lubricant into 19.6 (g) of carrier is introduced into a 50-ml polyethylene bottle. The bottle is shaken by hand 150 times under an environment of 23° C. and 60% RH. Then, 0.4 to 0.5 (g) of the above-mentioned mixture is introduced into a metal measurement container 40 including a 500 mesh screen 41 arranged at the bottom, and a metal lid 42 is covered. The mass of the entire measurement container 40 at this time is represented by W1 (*g*). Next, with use of a suction machine having an insulating member at a part to be brought into contact with the measurement container 40, air is sucked through a suction port 45, and an airflow amount adjusting valve 44 is adjusted, to thereby set a pressure of a vacuum gauge 43 to 250 (mmAq). In this state, air is sucked for one minute, to suck and remove the developer. A potential of a potentiometer 46 at this time is represented by V (volt). A capacitor 47 with a capacitance C (μF) is connected in parallel to the input of the potentiometer 46. The mass of the entire measuring machine after suction is represented by W2 (*g*). The triboelectric charge amount (μC/g; mC/kg) of the developer is calculated as follows.

$$\text{Triboelectric charge amount}(\mu C/g;mC/kg)=CV/(W1-W2)$$

When the charge amounts of the developer and the lubricant used in the embodiment were measured with the measuring method, the charge amount of the developer was −84 μC/g, and the charge amount of the lubricant was −196 μC/g. In other words, the lubricant is charged to the same polarity (negative polarity) as the developer, and the charge amount of the lubricant is larger in absolute value than the charge amount of the developer.

Now, examples of the powder that may be used as the lubricant in the present invention will be described, but the present invention is not limited to those examples.

As resin powder, there is given, powder of, for example: a silicone resin; a polyalkylene resin such as polyethylene or polypropylene; a fluorine-based resin such as polyvinylidene fluoride or polytetrafluoroethylene; a polyester-based resin such as polyethylene terephthalate or polybutylene terephthalate; a styrene-based resin such as polystyrene; an acrylic resin such as polymethyl methacrylate; a styrene acrylic resin such as a styrene methyl methacrylate copolymer; a phenol-based resin; a urea resin; a melamine resin; an epoxy resin; a urethane-based resin; or a polyamide resin.

Further, as powder of a fatty acid or a metal salt thereof, there is given, powder of, for example: a fatty acid including a long-chain fatty acid such as undecylic acid, myristic acid, lauric acid, undecanoic acid, palmitic acid, pentadecanoic acid, stearic acid, heptadecanoic acid, arachic acid, montanic acid, oleic acid, linoleic acid, or arachidonic acid; or a metal salt including a salt with a metal such as zinc, iron, magnesium, aluminum, calcium, sodium, or lithium.

Further, as inorganic powder, there may be used powder of, for example, an inorganic metal oxide, an inorganic nitride, an inorganic carbide, a sulfate, or a metal carbonate. A specific example thereof is powder of, for example: an oxide such as silicon oxide, titanium oxide, strontium titanate, or aluminum oxide (alumina); a nitride such as boron nitride or silicon nitride; a carbide such as silicon carbide, titanium carbide, or boron carbide; or a boride such as tungsten boride.

The surfaces of the above-mentioned powders may be subjected to surface treatment with use of a silane coupling agent, a titanium coupling agent, silicone oil, a polymeric fatty acid, or a metal salt thereof, to thereby perform hydrophobizing treatment or control in triboelectric charging characteristics.

Further, the information on the triboelectric charging performance of the exemplified powders can be obtained by evaluating whether the powder is positively charged or negatively charged with respect to a substance or a product serving as a reference of triboelectric charging. However, as a general tendency, for example, the silicone resin, the fluorine-based resin, and the polyester-based resin have a strong tendency to be negatively charged. In addition, for example, the phenol-based resin, the melamine resin, the epoxy resin, the urethane-based resin, and the polyamide resin have a strong tendency to be positively charged.

(Configuration of Lubricant Coating Device)

Figure 4:
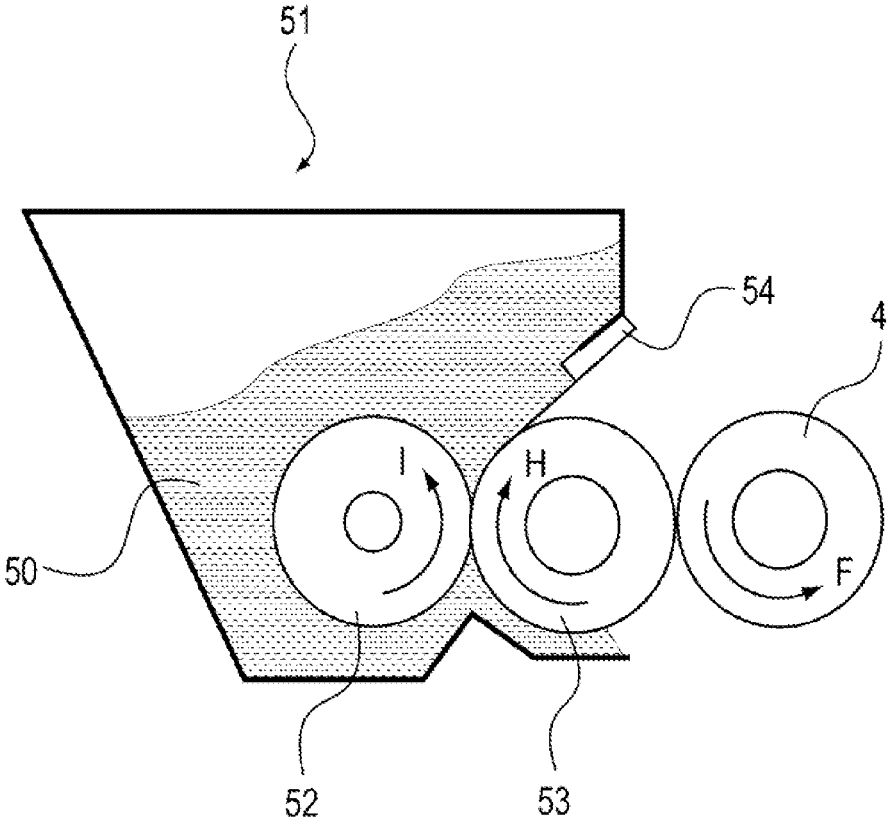
FIG. 4 is a view illustrating a configuration of a coating device configured to coat a developing roller with lubricant according to the embodiment.

FIG. 4 is a view illustrating a configuration of a coating device 51 configured to coat the developing roller 4 with lubricant. Note that, FIG. 4 is a sectional view of the coating device 51 taken along the plane perpendicular to the longitudinal direction (rotation axis direction) of the developing roller 4.

As illustrated in FIG. 4, the coating device 51 includes a coating roller 53 configured to coat the developing roller 4 with lubricant 50, a lubricant supply roller 52 configured to supply the lubricant 50 to the coating roller 53, and a lubricant amount regulating member 54 configured to regulate a lubricant amount on the coating roller 53. Further, the coating device 51 accommodates the lubricant 50 therein. Further, the developing roller 4 can be rotationally mounted to the coating device 51 through intermediation of a mounting member (not shown).

The developing roller 4, the coating roller 53, and the lubricant supply roller 52 rotate in the directions indicated by the arrow F, the arrow H, and the arrow I, respectively, by receiving the driving force of the driving motor (not shown).

First, the lubricant supply roller 52 is an elastic sponge roller obtained by forming a foam layer on the outer circumference of a conductive cored bar, and is arranged so as to form a predetermined contact portion on the circumferential surface of the coating roller 53. The lubricant supply roller 52 rotates in the direction indicated by the arrow I to supply the contained lubricant 50 to the coating roller 53.

The lubricant 50 supplied to the coating roller 53 by the lubricant supply roller 52 enters the contact abutment portion with respect to the lubricant amount regulating member 54 by rotation of the coating roller 53 in the direction indicated by the arrow H. Then, the lubricant 50 is triboelectrically charged due to the rubbing between the surface of the coating roller 53 and the lubricant amount regulating member 54. Thus, the lubricant 50 is charged, and simultaneously its layer thickness is regulated. The lubricant 50 on the coating roller 53, which has its layer thickness regulated, is conveyed to a portion opposed to the developing roller 4 by the rotation of the coating roller 53. Then, a coating bias source (not shown) applies, to the coating roller 53, a bias sufficient to transfer the lubricant onto the developing roller 4. With this, the lubricant 50 on the coating roller 53 is transferred onto the developing roller 4, and the developing roller 4 can be uniformly coated with the lubricant 50 in the longitudinal direction.

(Damage Due to Depletion of Lubricant)

The developing roller 4 is coated with lubricant, and thus it is possible to suppress the friction between the developing roller 4 and the toner supply roller 5 or the friction between the developing roller 4 and the regulating member 8, which is caused along with the rotational drive of the developing device 3. As a result, a load (torque) necessary for driving the developing device 3 can be reduced.

However, if the developing roller 4 is simply coated with lubricant, when the new developing device 3 is used, a problem described below may occur, and the developing roller 4 and the regulating member 8 may be damaged.

The surface of the developing roller 4 of the new developing device 3 is coated with the lubricant. On the other hand, after the start of drive of the developing device 3, a time is required for the toner to be supplied to the developing roller 4. Therefore, in order to suppress the friction to be generated between the developing roller 4 and the toner supply roller 5 or between the developing roller 4 and the regulating member 8, which is caused along with the rotational drive of the developing device 3, it is necessary to retain the lubricant on the surface of the developing roller 4 for a while. In other words, it is necessary to retain the lubricant on the surface of the developing roller 4 while the toner is supplied to the developing chamber 18*a* by the developer conveying member 22, the toner is supplied to the developing roller 4 by the toner supply roller 5, and the surface of the developing roller 4 is coated with toner.

However, if the developing roller 4 and the toner supply roller 5 are simply rotated, the lubricant is immediately collected inside the toner supply roller 5 made of a foam material (elastic sponge) due to the rubbing between the developing roller 4 and the toner supply roller 5. In this case, the lubricant is depleted before the surface of the developing roller 4 is coated with the toner. As a result, the torque for driving the developing device 3 is increased due to the friction generated between the developing roller 4 and the toner supply roller 5 or between the developing roller 4 and the regulating member 8.

Therefore, in the embodiment, in order to suppress occurrence of the above-mentioned problem, a sequence for retaining the lubricant applied on the developing roller 4 is executed from the start of the use of the developing device 3 until the surface of the developing roller 4 is coated with toner.

(Lubricant Retention Operation (Lubricant Retention Sequence, First Sequence))

Next, an operation of retaining the lubricant when the developing device 3 is determined to be in an initial state will be described.

Figure 13:
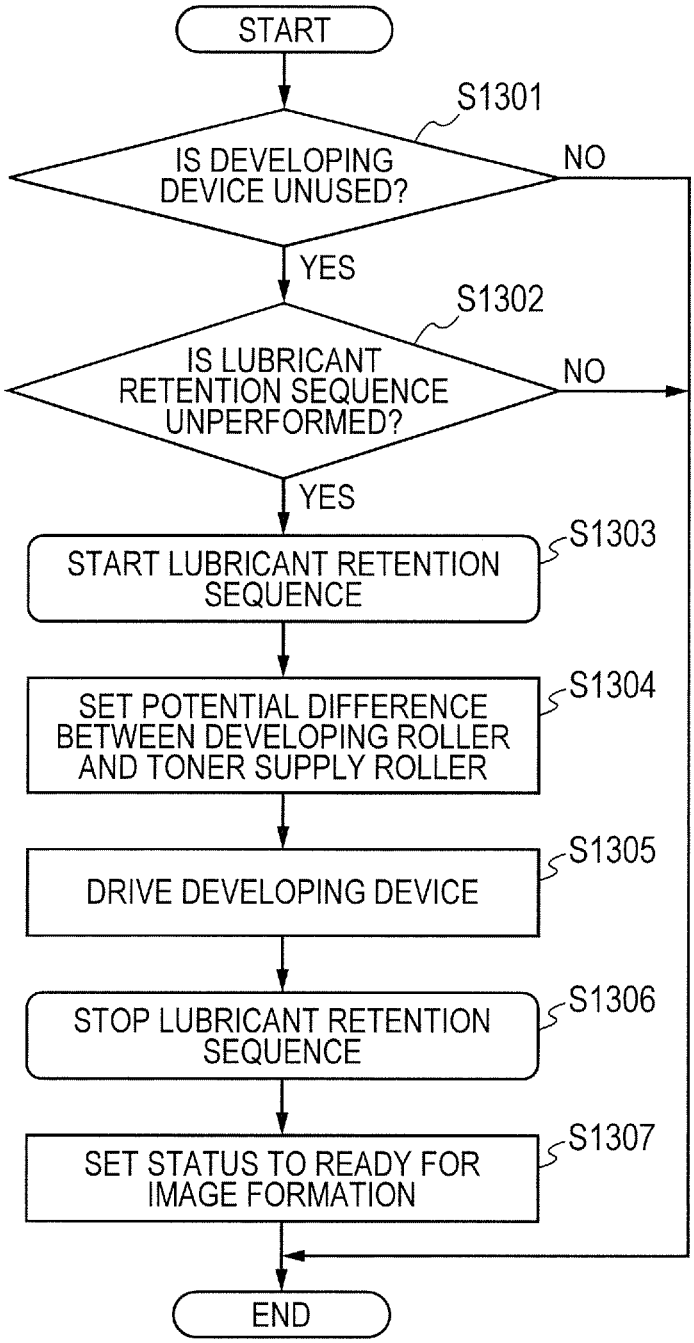
FIG. 13 is a flowchart illustrating an operation of retaining the lubricant according to the first embodiment.

FIG. 13 is a flowchart illustrating the operation of retaining the lubricant (lubricant retention operation).

As illustrated in FIG. 13, when the developing device 3 is unused (Step S1301, use detecting device), and when the lubricant retention sequence is unperformed (Step S1302), the lubricant retention sequence is started (Step S1303).

That is, the use history representing whether or not the developing device 3 is used is detected in Step S1301, and the lubricant retention sequence is started only when the unused state is detected.

When the lubricant retention sequence is started, a potential difference between the developing roller 4 and the toner supply roller 5 is set (Step S1304). Then, the process cartridge SC (developing device 3) is driven (Step S1305). After a predetermined time period has elapsed, the lubricant retention sequence is stopped (Step S1306), and an image forming status of the image forming apparatus 100 is set to ready for image formation (Step S1307). Then, the lubricant retention operation is ended.

(Bias Control)

Now, bias control between the developing roller 4 and the toner supply roller 5, which is executed in Step S1304 in the lubricant retention sequence (first sequence), will be described.

In the embodiment, −400 V is applied to the developing roller 4, and −650 V is applied to the toner supply roller 5. In other words, voltages to be applied are set so that an electric field for urging a negative-polarity coating agent toward the developing roller 4 is formed between the developing roller 4 and the toner supply roller 5. Further, the potential difference between the developing roller 4 and the toner supply roller 5 is set larger than that during the normal image formation. Thus, the movement of the negatively charged lubricant from the developing roller 4 to the toner supply roller 5 can be suppressed. In other words, a state in which the developing roller 4 retains the coating agent is maintained.

Further, the time period for performing the above-mentioned bias control between the developing roller 4 and the toner supply roller 5 is determined depending on a time period required for the developer conveying member to lift the toner 10 from the developer containing chamber 18*b* to the developing chamber 18*a*. In the embodiment, the developer conveying member 22 is driven at rpm, and hence the time period required for the developer conveying member 22 to lift the toner 10 is 2.7 seconds at maximum. Therefore, the time period for performing the above-mentioned bias control is set to be longer than the time period required for the developer conveying member 22 to lift the toner 10. That is, the bias control for the lubricant retention sequence (first sequence) is performed for three seconds from the start of the drive of the process cartridge SC.

(Verification of Effect)

A verification test for verifying the effect of the embodiment will be described.

Under the initial state of the process cartridge SC, the remaining amount of lubricant on the surface of the developing roller 4 with respect to the driving time of the process cartridge SC was evaluated. Note that, in the initial state of the process cartridge SC, the weight of the lubricant applied onto the surface of the developing roller 4 is set to 50 mg.

FIG. 12 is a table showing the results of the verification of the effect of the embodiment.

A comparative example represents a case where the developing roller 4 and the toner supply roller 5 are set to have the same potential in the embodiment. At this time, the bias to be applied to the toner supply roller is reduced to −400 V to achieve the same potential.

In the comparative example, it is found that the lubricant on the surface of the developing roller 4 vanishes after two seconds from the start of the drive of the process cartridge SC.

On the other hand, in the embodiment, it is found that 35 milligrams [mg] of lubricant is still retained even after three seconds, which corresponds to a timing at which the surface of the developing roller 4 is coated with toner.

As described above, in the embodiment, the potential difference is applied between the developing roller 4 and the toner supply roller 5 so that the lubricant can be retained on the surface of the developing roller 4.

Second Embodiment

Next, another embodiment of the present invention will be described. In the following description, description of parts similar to those in the above-mentioned first embodiment is omitted.

(Image Defect Caused by Lubricant)

Also in the embodiment, similarly to the first embodiment, the developing roller 4 is coated with lubricant. With this, the friction between the developing roller 4 and the toner supply roller 5 or between the developing roller 4 and the regulating member 8 can be suppressed during the initial stage of use of the developing device 3, and the torque necessary for driving the developing device 3 can be reduced.

However, on the other hand, when the lubricant and the toner are present on the developing roller 4 in a mixed manner, and when the image is formed in this state, a problem as described below may occur to deteriorate the image quality.

When the lubricant and the toner are present on the developing roller 4 in a mixed manner, the toner is charged by triboelectric charging due to the rubbing against the regulating member 8, and is also charged due to the rubbing against the lubricant. Therefore, as compared to the case where the toner is not mixed with the lubricant, the charge amount of the toner becomes excessive. In this case, difference in charge amount of toner is caused between a part in which the toner is mixed with the lubricant and a part in which the toner is not mixed with the lubricant, which causes difference in developing performance with respect to the same latent image potential.

Further, in a part in which the lubricant and the developer are mixed with each other, the amount of increase in charge amount when the toner on the developing roller 4 is subjected to rubbing a plurality of times, such as at the time of rotation before image formation or a so-called inter-sheet time between the recording material and the recording material, is also increased as compared to the case where the lubricant and the developer are not mixed with each other. Therefore, the difference in developing performance of toner depending on the number of times of rubbing is also increased. The difference in developing performance caused as described above leads to difference in amount of the toner to be developed with respect to the latent image potential.

As a result, when a solid black image (image having a maximum coverage rate by printing the entire image formable region) is printed in a state in which the toner and the lubricant are present on the developing roller 4 in a mixed manner in a wide range, unevenness in density occurs in a wide range of the image. This problem tends to occur when the lubricant applied onto the developing roller 4 is not sufficiently removed in the initial stage.

Further, when the solid black image is printed in a state in which the lubricant is present on just a small portion of the developing roller 4, the difference in developing performance appears in the small portion. Therefore, a white dot image (image having a dotted part in which the toner does not transfer (or only slightly transfers) onto the recording medium) occurs. This problem tends to occur when the lubricant collected inside the toner supply roller 5 or the developing chamber 18*a* is supplied onto the developing roller 4 again.

As described above, when the lubricant remains on the surface of the developing roller 4, an image defect may occur. Therefore, it is necessary to execute a sequence of removing the lubricant applied onto the developing roller 4 from the developing roller 4 and discharging the lubricant outside of the developing device 3 after the start of the use of the process cartridge SC.

(Lubricant Removing Operation)

Next, an operation of forcibly removing the lubricant when the developing device 3 is determined to be in the initial state will be described.

Figure 5:
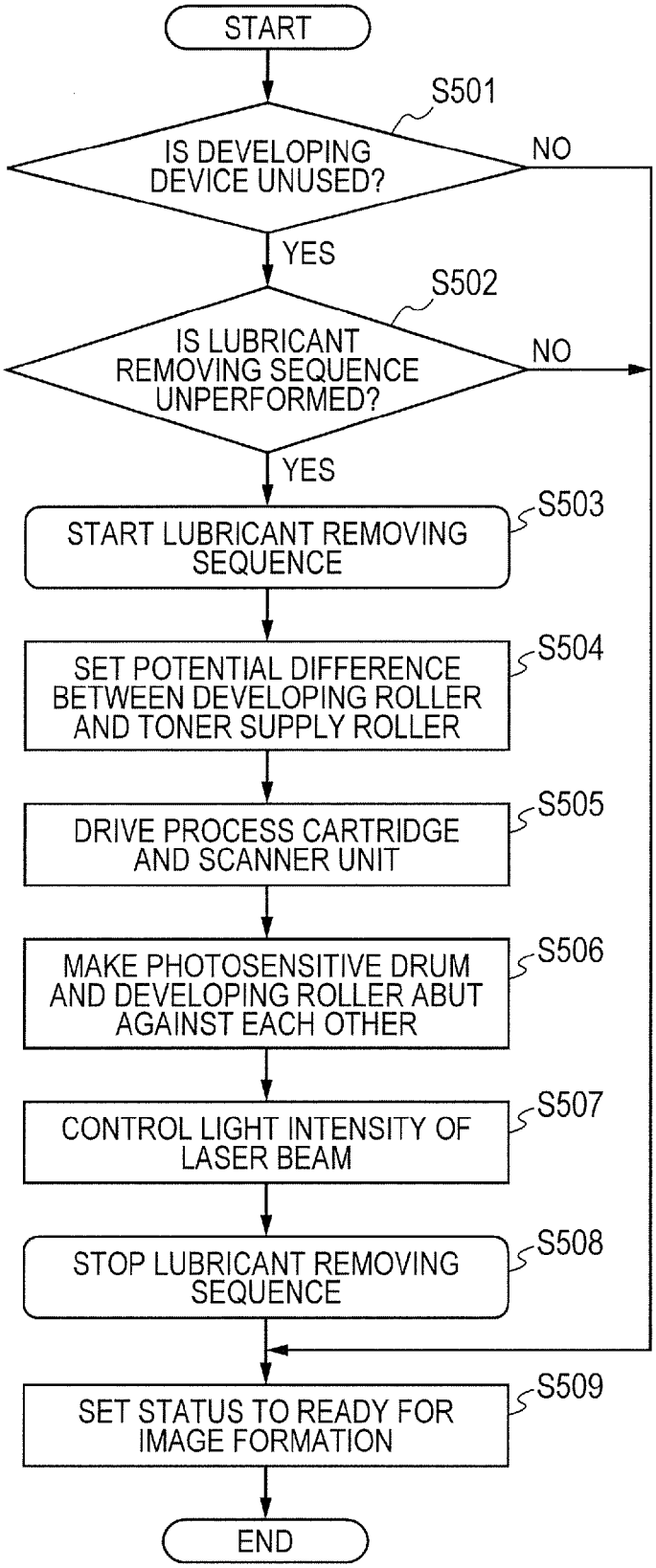
FIG. 5 is a flowchart illustrating an operation of removing the lubricant according to the embodiment.

FIG. 5 is a flowchart illustrating the operation of removing the lubricant.

As illustrated in FIG. 5, when the developing device 3 is unused (Step S501, use detecting device), and when the lubricant removing sequence is unperformed (Step S502), the lubricant removing sequence is started (Step S503). That is, the use history representing whether or not the developing device 3 is used is detected in Step S501, and the lubricant removing sequence is started only when the unused state is detected.

When the lubricant removing sequence is started, the potential difference between the developing roller 4 and the toner supply roller 5 is set (Step S504, first sequence). Then, the process cartridge SC and the scanner unit 30 are driven (Step S505) to bring the photosensitive drum 1 and the developing roller 4 into abutment against each other (Step S506). Next, the light intensity of the laser beam 11 to be output from the scanner unit 30 is controlled (Step S507, second sequence). After that, the lubricant removing sequence is stopped (Step S508), and then the image forming status of the image forming apparatus 100 is set to ready for image formation (Step S509). Then, the lubricant removing operation is ended.

(Bias Control and Laser Beam Light Intensity Control)

Now, the bias control between the developing roller 4 and the toner supply roller 5 and the control on the light intensity of the laser beam 11 to be radiated to the photosensitive drum 1 in the lubricant removing sequence will be described.

Figure 6A:
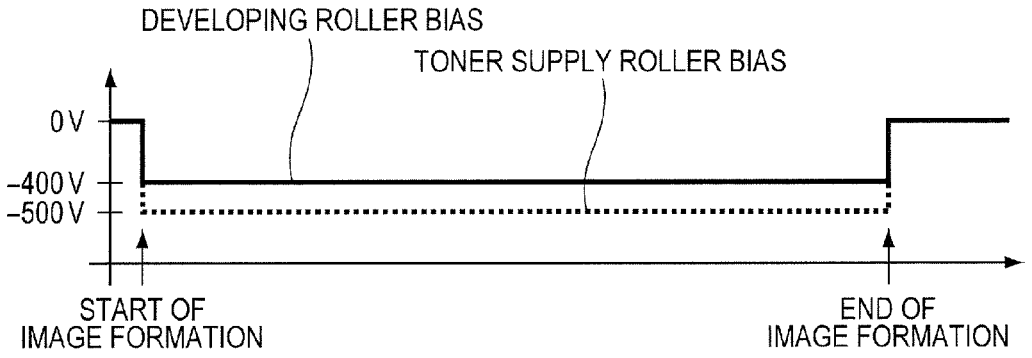
FIG. 6A is a timing chart illustrating biases to be applied to the developing roller and a toner supply roller during image formation.
Figure 6B:
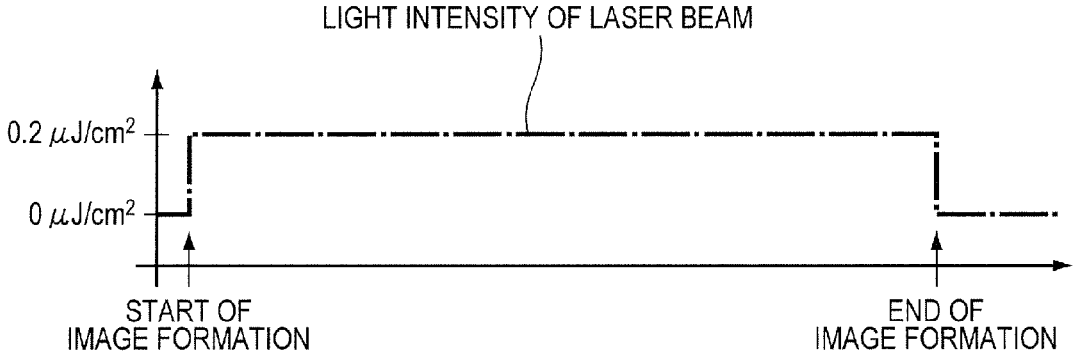
FIG. 6B is a timing chart illustrating control on light intensity of a laser beam when a solid black image is printed.

FIG. 6A is a timing chart illustrating biases to be applied to the developing roller 4 and the toner supply roller 5 during image formation, and FIG. 6B is a timing chart illustrating control on the light intensity of the laser beam 11 when a solid black image is printed.

Figure 7A:
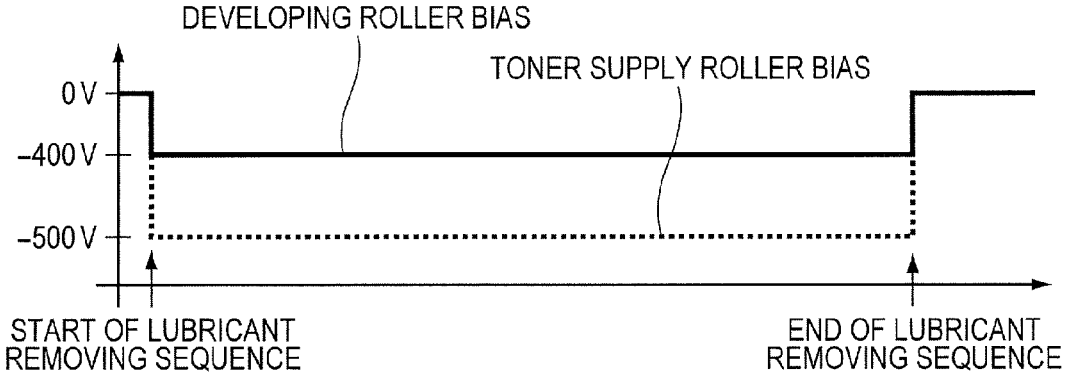
FIG. 7A is a timing chart illustrating biases to be applied to the developing roller and the toner supply roller during a lubricant removing sequence.
Figure 7B:
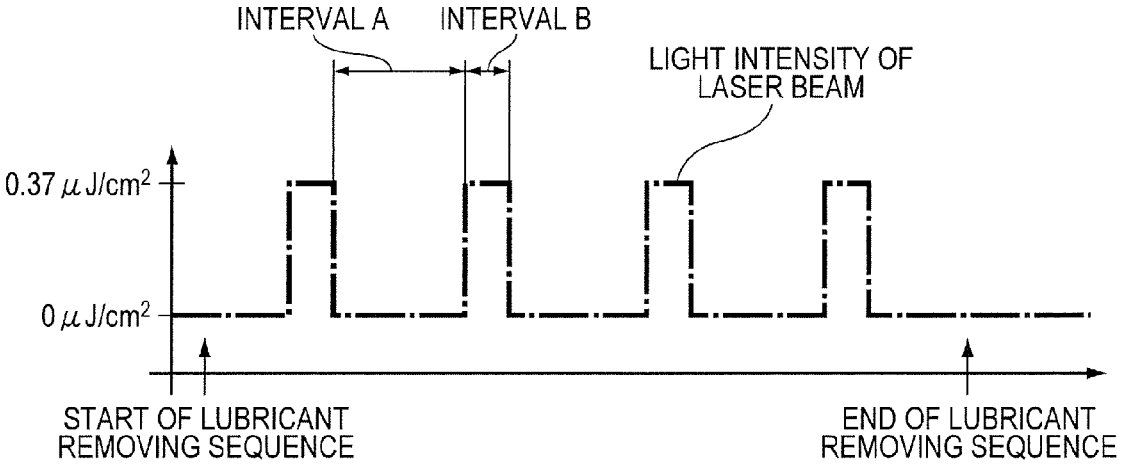
FIG. 7B is a timing chart illustrating control on the light intensity of the laser beam during the lubricant removing sequence.

FIG. 7A is a timing chart illustrating biases to be applied to the developing roller 4 and the toner supply roller 5 during the lubricant removing sequence, and FIG. 7B is a timing chart illustrating control on the light intensity of the laser beam 11 during the lubricant removing sequence.

As illustrated in FIG. 6A, during image formation, the potential difference between the developing roller 4 and the toner supply roller 5 is set to 100 V. The value is set so as to prevent the amount of toner to be supplied to the developing roller 4 from being insufficient or excessive. Further, the light intensity of the laser beam 11 is set considering the image quality and the character quality, and as illustrated in FIG. 6B, the light intensity is controlled to be constant from the start of the image formation to the end of the image formation.

On the other hand, as illustrated in FIG. 7A, during the lubricant removing sequence, the potential difference between the developing roller 4 and the toner supply roller 5 is increased as compared to that during the image formation, to thereby suppress transfer of the lubricant from the developing roller 4 onto the toner supply roller 5. In the embodiment, −400 V is applied to the developing roller 4, and −650 V is applied to the toner supply roller 5. In this manner, the movement of the negatively charged lubricant from the developing roller 4 to the toner supply roller 5 is suppressed.

Note that, the control to be executed in Step S504 in the embodiment is the same as the control in the lubricant retention step described in the first embodiment (see FIG. 13, Step S1304). In other words, in order to discharge (remove) the lubricant from the developing device 3, the lubricant is collected on the developing roller (the developing roller is caused to retain the lubricant). In other words, in the embodiment, the lubricant retention sequence (first sequence) is executed also in the lubricant removing sequence. Next, as illustrated in FIG. 7B, in the control on the light intensity of the laser beam 11 in the lubricant removing sequence, in the embodiment, an interval A (first period) and an interval B (second period) are provided. Further, in the interval A, the light intensity of the laser beam 11 was controlled to 0 $\mu J/cm^2$, and the controlled light intensity was maintained for 2.8 seconds. Further, in the interval B, the light intensity of the laser beam 11 was controlled to 0.4 $\mu J/cm^2$, and the controlled light intensity was maintained for 0.13 seconds.

The interval A is set so that the lubricant or the toner does not transfer from the developing roller 4 onto the photosensitive drum 1. When the developing roller is rotationally driven in this state, the lubricant having a stronger negative polarity than that of the toner remains on the developing roller 4, and the toner is scraped off from the developing roller 4 by the toner supply roller 5 or the regulating member 8. That is, in the interval A, the light intensity of the laser beam 11 is set so that the lubricant is urged in the direction from the photosensitive drum 1 to the developing roller 4. In other words, the potential of the photosensitive drum 1 and the potential of the developing roller 4 are set so that an electric field for urging the negative-polarity lubricant in the direction from the photosensitive drum 1 toward the developing roller 4 is formed between the photosensitive drum 1 and the developing roller 4.

In this manner, the ratio of the lubricant can be increased from the state in which the toner and the lubricant are present on the developing roller 4 in a mixed manner.

On the other hand, in the interval B, the photosensitive drum 1 is irradiated with the laser beam 11 having light intensity larger than that during the image formation, to thereby create a deeper latent image potential than that during the image formation. In this manner, the lubricant on the developing roller 4 is efficiently transferred onto the photosensitive drum 1. That is, in the interval B, the light intensity of the laser beam 11 is set so that the lubricant is urged in the direction from the developing roller 4 to the photosensitive drum 1. In other words, in the interval B, the photosensitive drum 1 is exposed with light, to thereby change the potential of the photosensitive drum 1. In other words, the absolute value of the potential of the photosensitive drum 1 is reduced, and thus the electric field formed between the photosensitive drum 1 and the developing roller 4 acts so as to urge the negative-polarity lubricant from the developing roller 4 toward the photosensitive drum 1.

That is, in the intervals A and B, the light intensity of the laser beam 11 is changed so that the potential difference is generated in a manner that the direction of the urging force acting on the lubricant changes between those intervals.

Note that, in the interval A, as the length of the interval increases, the ratio of the lubricant (ratio of the lubricant to the toner) on the developing roller 4 increases. On the other hand, in the interval B, as the length of the interval increases, unnecessary toner is transferred from the developing roller 4 onto the photosensitive drum 1. Therefore, the length of the interval A is set larger than that of the interval B, to thereby move the lubricant efficiently onto the photosensitive drum 1 while suppressing toner consumption to the minimum.

The interval A and the interval B are alternately repeated a plurality of times, to thereby efficiently discharge the lubricant remaining on the developing roller 4 or the lubricant collected inside the toner supply roller 5 or the developing chamber 18*a*. In other words, in Step S504, an electric field is formed between the developing roller 4 and the toner supply roller 5, and hence the lubricant is collected on the developing roller 4 in the interval A, which increases the ratio of the lubricant to the toner carried by the developing roller 4. In the interval B, the lubricant collected on the developing roller 4 is discharged toward the photosensitive drum 1. At this time, the toner carried by the developing roller 4 is also moved to the photosensitive drum 1 together with the lubricant. However, in the interval A, the ratio of the toner to the lubricant carried by the developing roller is reduced. Therefore, in the interval B, the amount of toner to be collected on the photosensitive drum 1 is small.

In other words, the step of collecting the lubricant on the developing roller 4 and then discharging the lubricant to the photosensitive drum 1 is repeated, to thereby efficiently remove (discharge) the lubricant from the developing device while suppressing consumption of the toner.

In the embodiment, setting was made to repeat the interval A and the interval B 10 times.

Note that, with the operation described with reference to FIGS. 5, 6A, 6B, 7A, and 7B, the lubricant moved onto the surface of the photosensitive drum 1 is removed from the surface of the photosensitive drum 1 by the cleaning member 6.

(Verification of Effect)

A verification test for verifying the effect of discharging the lubricant will be described.

Under an environment of low-temperature and low-humidity conditions (temperature of 15° C. and humidity of 10%), a two-sheet intermittent print endurance test was performed. In this print endurance test, horizontal lines at an image ratio of 1% are printed. In the print endurance test, the lubricant removing sequence was performed on the process cartridge in the initial state for shipping, and an image for evaluating an image defect was printed at each time point just after this sequence was executed, 5,000 sheets, 10,000 sheets, 15,000 sheets, and 20,000 sheets. This time, a solid black image was used for the image for evaluating an image defect.

With this solid black image, whether or not the uneven density or the white dot has occurred was evaluated.

The uneven density was ranked as follows.

A: density difference in the solid black image is less than 0.05.

B: density difference in the solid black image is 0.05 or more and less than 0.1.

C: density difference in the solid black image is 0.1 or more.

The uneven density of the solid black image was measured by measuring the density of the printed solid black image with use of SPECTRODENSITOMETER 500 manufactured by X-Rite Inc., to thereby evaluate the density difference in the solid black image. Further, in the embodiment, setting is made so that the average density in a non-lubricant state is about 1.40.

The white dot was ranked as follows.

A: no white dot occurs in the solid black image.

B: slight white dots occur in the solid black image.

C: clear white dots occur in the solid black image.

Comparative Examples

FIG. 8 is a table showing the toner supply roller bias, the light intensity of the laser beam, and presence or absence of the interval A in the embodiment and comparative examples.

In FIG. 8, Comparative Example 1 represents a case where the lubricant removing operation was performed while the bias of the toner supply roller 5 and the light intensity of the laser beam 11 were set similarly to those during the normal image formation. Further, during the lubricant removing sequence, the interval A was not provided, and the lubricant was continuously removed.

Comparative Example 2 represents a case where the lubricant removing operation was performed while the bias of the toner supply roller 5 and the light intensity of the laser beam 11 were set similarly to those in the second embodiment. Note that, during the lubricant removing sequence, the interval A was not provided, and the lubricant was continuously removed.

Comparative Example 3 represents a case where, similarly to Comparative Example 1, the lubricant removing operation was performed while the bias of the toner supply roller 5 and the light intensity of the laser beam 11 were set similarly to those during the normal image formation. Note that, during the lubricant removing sequence, the interval A was provided.

FIG. 9 is a table showing results of a verification experiment performed in the embodiment and the comparative examples shown in FIG. 8.

When control is performed as in Comparative Example 1 so that the lubricant removing sequence is executed while the bias of the toner supply roller 5 and the light intensity of the laser beam 11 are set similarly to those during the image formation without providing the interval A, the removing operation is performed in a state in which the ratio of the lubricant on the developing roller 4 is still low. In this case, the consumption amount of toner is larger than that of lubricant, and hence the removal of the lubricant becomes insufficient. Therefore, a large amount of lubricant remains on the developing roller 4, or the lubricant is collected inside the developer container. As a result, in the solid black image, an uneven density image occurs. Further, when the number of printed sheets of endurance increases, the lubricant collected inside the developer container is supplied to the developing roller 4, and thus an image with clear white dots occurs.

When control was performed as in Comparative Example 2 so that the bias of the toner supply roller 5 and the light intensity of the laser beam 11 were set similarly to those of the second embodiment without providing the interval A, improvement was observed as compared to Comparative Example 1. However, the removal of the lubricant was still insufficient, and an image with slightly uneven density and an image with slight white dots occurred.

Further, under control without the interval A as in Comparative Example 1 and Comparative Example 2, the removing operation is continuously performed while the ratio of the lubricant on the developing roller 4 is still low. Thus, a large amount of toner is consumed, which causes disadvantages to the user and hence is not preferred.

Further, when the removing operation is performed in the setting for the normal image formation as in Comparative Example 3, the lubricant cannot be sufficiently discharged outside of the developing chamber, and part of the lubricant remains on the developing roller 4 or the lubricant is collected inside the developer container. As a result, an image with slightly uneven density occurred from just after the start of the use of the process cartridge to about 5,000 sheets. Further, when the number of printed sheets of endurance increased, the lubricant collected inside the developer container was supplied to the developing roller 4, which caused occurrence of a white dot image.

On the other hand, in the embodiment, the interval A is provided, and thus the removing operation can be performed while the ratio of the lubricant on the developing roller 4 is sufficiently increased. Therefore, occurrence of an uneven density image can be prevented. Further, a white dot image to occur along with the use of the process cartridge was also able to be suppressed to a slight level. This is because the amount of the lubricant to be collected inside the developer container was able to be suppressed. Further, under control of the embodiment, the operation of the interval B during the sequence can be executed in a state in which the ratio of the lubricant is sufficiently increased. Therefore, minimum toner consumption can be attained.

As described above, in the embodiment, even when the developing roller 4 is coated with lubricant at the initial stage for shipping, occurrence of an uneven density image and a white dot image can be suppressed in the solid black image.

Third Embodiment

Next, another embodiment will be described. In the following description, description of parts similar to those in the above-mentioned first and second embodiments is omitted.

In the embodiment, in addition to the execution of the control described in the second embodiment, a lubricant removing sequence is performed at a timing at which the number of image printed sheets reaches a predetermined number of sheets.

Figure 10:
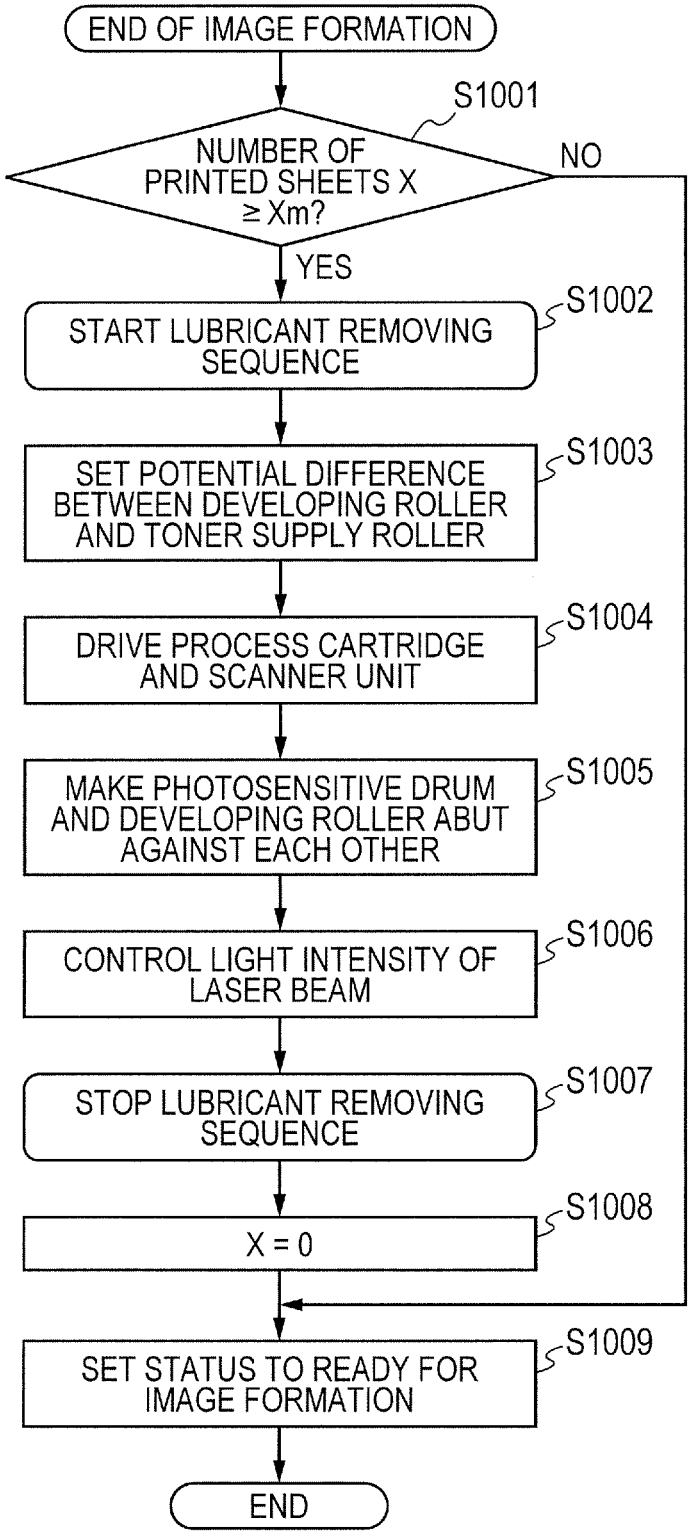
FIG. 10 is a flowchart illustrating a lubricant removing sequence to be executed at a timing at which the number of image printed sheets reaches a predetermined number of sheets according to a third embodiment.

FIG. 10 is a flowchart illustrating the lubricant removing sequence to be executed at a timing at which the number of image printed sheets reaches a predetermined number of sheets according to the embodiment.

As illustrated in FIG. 10, after the image formation is ended, when the number X of printed sheets represented by a printed sheet number counter is equal to or more than a predetermined number Xm of printed sheets (Step S1001, count unit), the lubricant removing sequence is started (Step S1002). That is, the number of images formed with use of the developing roller 4 is counted in Step S1001, and the lubricant removing sequence is executed when this number is equal to or more than a predetermined number.

When the lubricant removing sequence is started, the potential difference between the developing roller 4 and the toner supply roller 5 is set (Step S1003). Then, the process cartridge SC and the scanner unit 30 are driven (Step S1004), to thereby bring the photosensitive drum 1 and the developing roller 4 into abutment against each other (Step S1005). Next, the light intensity of the laser beam 11 to be output from the scanner unit 30 is controlled (Step S1006). After that, the lubricant removing sequence is stopped (Step S1007), and then the number X of printed sheets represented by the printed sheet number counter is set to "0" (Step S1008). After that, the image forming status of the image forming apparatus 100 is set to "ready for image formation" (Step S1009). Then, the lubricant removing operation is ended.

On the other hand, in Step S1001, when the number X of printed sheets represented by the printed sheet number counter is less than the predetermined number Xm of printed sheets set in advance, the image forming status of the image forming apparatus 100 is set to "ready for image formation" (Step S1009), and the lubricant removing operation is ended.

That is, after the image formation, the number X of printed sheets is compared with the predetermined number Xm of printed sheet set in advance. When the number X of printed sheets is determined to be Xm or more, the lubricant removing sequence is started. The details of the control performed in the lubricant removing sequence are similar to the control described in the second embodiment, and hence detailed description thereof is omitted.

(Verification of Effect)

In order to verify the effect of the embodiment, a verification test similar to that performed in the second embodiment was performed.

FIG. 11 is a table showing the results of the verification of the effect of the embodiment. Note that, in the embodiment, an experiment was performed while setting the value of Xm to 500.

As described in the second embodiment, when the sequence was executed only when the process cartridge SC was in the initial state, an image with slight white dots was generated. The reason is considered to be because the lubricant that had been partially collected into the toner supply roller 5 or the developing chamber 18*a* was supplied again onto the developing roller 4 as the cartridge was used.

On the other hand, in the embodiment, the lubricant removing sequence is executed at a timing at which the number of image printed sheets reaches a predetermined number of sheets, and hence also the lubricant collected inside the toner supply roller 5 or the developing chamber 18*a* can be forcibly removed. As a result, as shown in FIG. 11, the uneven density image and the white dot image were not generated in the solid black image from the start to the end of the use of the process cartridge SC.

Finally, the effects of the respective embodiments disclosed in this application may be summarized as follows.

According to the embodiments, the lubricant retention sequence allows the lubricant to be retained by the developer carrying member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-047689, filed Mar. 11, 2014, and Japanese Patent Application No. 2015-011979, filed Jan. 26, 2015, which are hereby incorporated by reference herein in their entirety.

What is claimed is:

1. An image forming apparatus, which is configured to form an image with use of developer, the image forming apparatus comprising:

an image bearing member configured to bear an image of the developer;

a developer carrying member configured to carry the developer so as to supply the developer to the image bearing member; and a developer supplying member configured to supply the developer to the developer carrying member, wherein at least a part of a surface of the developer carrying member is coated with lubricant, wherein the lubricant is to be charged to the same polarity as the developer, wherein an absolute value of a charge amount per unit mass of the lubricant is larger than an absolute value of a charge amount per unit mass of the developer, and wherein the image forming apparatus is configured to execute a first sequence of applying a potential difference between the developer supplying member and the developer carrying member before image formation to form an electric field to suppress movement of the charged lubricant from the developer carrying member to the developer supply member.

2. An image forming apparatus according to claim 1, further comprising:

a developing chamber including the developer carrying member and the developer supplying member; and a developer containing chamber arranged below the developing chamber and configured to contain the developer, the developer containing chamber including a developer conveying member configured to convey the developer to the developing chamber, wherein, before the first sequence is ended, the developer conveying member conveys the developer from the developer containing chamber to the developing chamber.

3. An image forming apparatus, which is configured to form an image with use of developer, the image forming apparatus comprising:

an image bearing member configured to bear an image of the developer;

a developer carrying member configured to carry the developer so as to supply the developer to the image bearing member; and a developer supplying member configured to supply the developer to the developer carrying member, wherein at least a part of a surface of the developer carrying member is coated with lubricant, wherein the image forming apparatus is configured to execute a lubricant removing sequence of removing the lubricant from the developer carrying member, and wherein the lubricant removing sequence includes:

a first sequence of applying a potential difference between the developer supplying member and the developer carrying member to form an electric field to suppress movement of the charged lubricant from the developer carrying member to the developer supply member; and a second sequence of applying a potential difference between the developer carrying member and the image bearing member to move the lubricant from the developer carrying member to the image bearing member.

4. An image forming apparatus according to claim 3, wherein the lubricant is to be charged to the same polarity as the developer, and wherein an absolute value of a charge amount per unit mass of the lubricant is larger than an absolute value of a charge amount per unit mass of the developer.

5. An image forming apparatus according to claim 3, wherein the second sequence alternately includes:

a first period for applying, between the image bearing member and the developer carrying member, a potential difference in a direction in which the lubricant is urged from the image bearing member to the developer carrying member; and a second period for applying, between the image bearing member and the developer carrying member, a potential difference in a direction in which the lubricant is urged from the developer carrying member to the image bearing member.

6. An image forming apparatus according to claim 5, wherein, in the second period, the potential difference in the direction in which the lubricant is urged from the developer carrying member to the image bearing member is larger than a potential difference between the developer carrying member and the image bearing member during image formation.

7. An image forming apparatus according to claim 5, wherein the first period is longer than the second period.

8. An image forming apparatus according to claim 5, further comprising a laser beam irradiation device configured to irradiate the image bearing member with a laser beam according to the image, wherein, in the second sequence, the potential difference in the first period and the potential difference in the second period are generated by changing light intensity of the laser beam to be output from the laser beam irradiation device.

9. An image forming apparatus according to claim 3, wherein the potential difference between the developer supplying member and the developer carrying member in the first sequence is larger than a potential difference between the developer supplying member and the developer carrying member during image formation.

10. An image forming apparatus according to claim 3, further comprising:

a first voltage applying device configured to apply a voltage to the developer carrying member; and a second voltage applying device configured to apply a voltage to the developer supplying member, wherein, in the first sequence, the potential difference is applied between the developer supplying member and the developer carrying member by a difference between the voltage output from the first voltage applying device and the voltage output from the second voltage applying device.

11. An image forming apparatus according to claim 3, further comprising a use detecting device configured to detect whether or not the developer carrying member is used, wherein the lubricant removing sequence is executed when the use detecting device detects that the developer carrying member is unused.

12. An image forming apparatus according to claim 11, wherein the developer carrying member and the developer supplying member are arranged in a process cartridge which is removably mounted to the image forming apparatus, and wherein the use detecting device detects whether or not the process cartridge is used.

13. An image forming apparatus according to claim 3, wherein the image forming apparatus repeatedly executes the lubricant removing sequence at a predetermined timing.

14. An image forming apparatus according to claim 3, further comprising a count device configured to count a number of images formed by the image forming apparatus with use of the developer carrying member, wherein the lubricant removing sequence is executed when the number of images counted by the count device reaches a predetermined number.

15. An image forming apparatus according to claim 3, wherein the lubricant removing sequence removes the lubricant while consuming the developer.

16. An image forming apparatus according to claim 3, further comprising a cleaning member configured to clean off the developer remaining on a surface of the image bearing member, wherein the lubricant that has moved onto the image bearing member in the lubricant removing sequence is removed from the surface of the image bearing member by the cleaning member.

* * * * *